United States Patent [19]

Folgero et al.

[11] Patent Number: 4,594,723

[45] Date of Patent: Jun. 10, 1986

[54] METHOD FOR PROVIDING PINCH CONTROL OF A TUNDISH CHANNEL-TYPE INDUCTOR

[75] Inventors: Kare Folgero; Sten Kollberg, both of Västerås, Sweden

[73] Assignee: ASEA AB, Västerås, Sweden

[21] Appl. No.: 586,261

[22] Filed: Mar. 5, 1984

[30] Foreign Application Priority Data

Mar. 7, 1983 [SE] Sweden ..... 8301225

[51] Int. Cl.[4] ..... H05B 5/00

[52] U.S. Cl. ..... 373/142; 164/437; 164/483; 164/488; 373/146; 373/159

[58] Field of Search ..... 164/483, 453, 437, 488; 266/44; 222/590, 591, 594, 593; 373/142, 146, 148, 159, 163, 149

[56] References Cited

U.S. PATENT DOCUMENTS

| | | | |
|---|---|---|---|
| 2,768,413 | 10/1956 | Alexanderson | 164/437 X |
| 2,937,789 | 5/1960 | Tama | 266/44 |
| 3,552,478 | 1/1971 | Lauener | 164/483 X |
| 3,991,263 | 11/1976 | Folgero et al. | 164/437 X |
| 4,441,191 | 4/1984 | Fredrikson et al. | 222/593 X |

FOREIGN PATENT DOCUMENTS

| | | | |
|---|---|---|---|
| 427234 | 11/1974 | U.S.S.R. | 222/594 |

*Primary Examiner*—Nicholas P. Godici
*Assistant Examiner*—J. Reed Batten, Jr.
*Attorney, Agent, or Firm*—Kenyon & Kenyon

[57] ABSTRACT

A method for continuously pouring molten metal in an initially substantially unfilled tundish having a channel-type inductor having a channel opening into the bottom portion of the tundish, is done by starting the pourings and the continuous sequential steps of applying power to the inductor when its channel is first covered by the poured metal to form a melt level and the static pressure of the metal is low and while increasing the power rapidly so as to cause incipient pinching in the channel and then momentarily rapidly reducing the power so as to prevent pinching; as the metal level further increases so that the metal's static pressure further increases, again increasing the power rapidly so as to again cause incipient pinching in the channel and then again momentarily rapidly reducing the power so as to prevent pinching; and continuing these sequential steps until the tundish is filled.

2 Claims, 5 Drawing Figures

METHOD FOR PROVIDING PINCH CONTROL OF A TUNDISH CHANNEL-TYPE INDUCTOR

Channel-type induction furnaces are used to heat molten metal or maintain its temperature. Such a furnace comprises a crucible with the channel-type inductor build in its bottom or bottom portion and into which the channel of the inductor opens, the channel being U-shaped and encircled by a magnetic core around which a primary coil powdered by AC is positioned, molten metal in the channel acting as the secondary and being heated by the current induced in the metal by the core.

The construction of such a furnace is well known.

The molten metal in the channel is not only heated but is forced to travel through the channel, the channel being kept filled with the molten metal by the static pressure of the metal in the crucible providing the level of the metal is high enough. If not high enough or if the powder applied to the inductor's primary coil is excessive for the prevailing level or height of metal above the inductor's channel openings, it is possible for the metal to be driven out through the channel so as to empty the channel. This is conventionally called the pinch effect or pinching.

Pinching can be detected by the sudden high reactive power in the inductor's AC power supply, a sudden reduction in the power current and in other ways, all being easily measurable values. This permits the pinch effect to be controlled by appropriate control of the inductor's power supply.

In the continuous casting of metal a tundish is used to supply the continuous casting mold, the tundish in turn being supplied by molten metal continuously cast into it from a large ladle. Using steel as an example, at the start-up of the continuous casting the tundish is empty and this results in cooling the metal poured from the ladle typically at a temperature of around 1500° C. This temperature drops undesirably during the initial filling of the tundish and to reduce this temperature drop it is possible to preheat the tundish, but such preheating is limited to temperatures of not more than 1000° C. for practical reasons such as expense and additional wear on the refractory lining of the tundish.

Like the channel-type inductor furnace the tundish can be provided with a channel-type inductor in its bottom or bottom portion and used in its conventional manner providing the tundish is full, meaning that the molten metal is at the level normally maintained after the start-up and when the continuous casting operation is proceeding normally.

However, during the start-up, when the level of the molten metal in the tundish may be only just high enough to fill the inductor's channel and permit its operation, the static pressure of the metal is very low, normal operation of the inductor promptly introduces the pinch effect with consequent emptying of the inductor's channel. This makes it impossible to use the inductor to uniformly return the metal gradually filling the tundish to the temperature it had when it was poured from the ladle.

Briefly summarized the present invention is a method for providing pinch control of the tundish channel-type inductor so as to permit the inductor to be operated at its maximum possible power during the filling of the tundish so that when full the metal in the tundish has been brought as rapidly as possible to the temperature it had when poured from the ladle into the tundish. After the tundish is filled the channel-type inductor can be operated normally because the maximum static pressure is provided.

According to the invention this control is done by powering the inductor with rapidly increasing power up to the point where the pinching effect is incipient because at the start the metal in the tundish provides a relatively small static pressure. Immediately upon detection of this point or pinch limit the inductor power is rapidly decreased. The tundish metal level is constantly increasing with increasingly available static pressure, and the inductor power is immediately increased rapidly after its sudden reduction to prevent pinching, but the static pressure remains insufficient to prevent pinching as the inductor power is rapidly further increasing and at the point of incipient pinching this power is again suddenly decreased only to be again applied increasingly and again dropped as the melt level in the tundish continues to rise and produce increasing static pressure. These steps of operation are continued until the tundish metal is at the normal operating level for the tundish or, in this sense, the tundish is full. In this way as the tundish fills the inductor can be operated at its maximum possible power without pinching actually occurring, the metal filling the tundish being heated with maximum rapidity in a relatively smooth manner until the tundish is full and permits the inductor to be operated in its normal manner, keeping the melt at casting temperature.

The invention is disclosed in more detail by the following with the aid of the accompanying drawings, in which.

Figure 1:
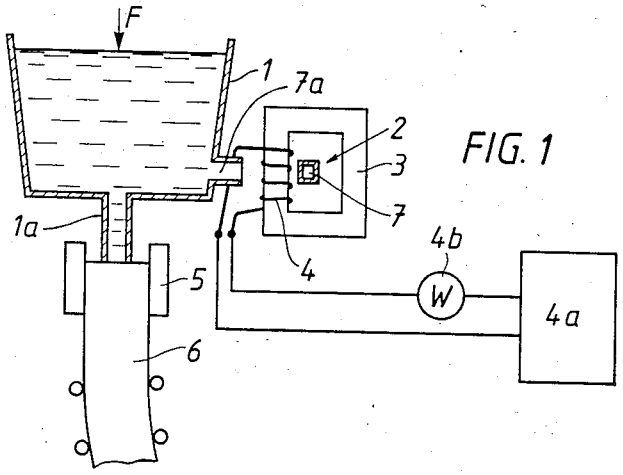
FIG. 1 is a schematic view showing the tundish as used for continuous casting and having a channel-type inductor in its bottom portion, and showing the continuous casting using the tundish, and the power supply for the inductor of the tundish.

Because of its industrial importance the continuous casting of steel is represented by FIG. 1 and the various graphs.

In FIG. 1 a tundish 1 is fed as indicated by arrow F with molten steel from a supply such as a large ladle (not shown). A channel-type inductor in the bottom of the side wall of the tundish is shown at 2 with its iron core 3 surrounding inductor channel 7 and the inductor's primary coil 4. The channel 7 is incompletely shown to avoid confusion but one of its openings into the tundish 1 is shown at 7A. Both legs of the channel of course open into the tundish at its bottom portion.

A continuous casting mold 5 is fed from the tundish via a casting pipe 1A into the top of the continuous casting mold 5 from which a cast strand 6 descends through the mold's bottom. During casting of the strand 6 molten steel must be continuously supplied to the top of the mold 5.

The inductor's coil 4 is powered by a conventional thyristor convertor 4A via a power indicator 4B.

At the start-up of the continuous casting the tundish 1 is empty and possibly has its refractory lining preheated possibly to a temperature as high as 1000° C.

Preheating at higher temperatures is impractical. At this time the inductor's channel 7 is either empty or filled with steel from a previous operation and as soon as the steel in the tundish rises above the channel's openings into the tundish, the inductor can be powered. If too much power is applied pinching will occur because the hydrostatic pressure of the steel is very low at this time.

Figure 2:
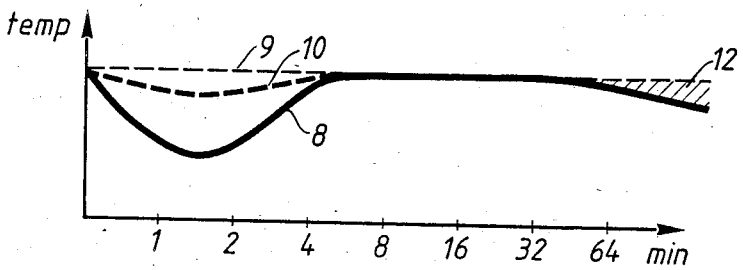
FIG. 2 is a graph showing temperature-time curves indicating the conditions prevailing during the filling of the tundish.
Figure 3:
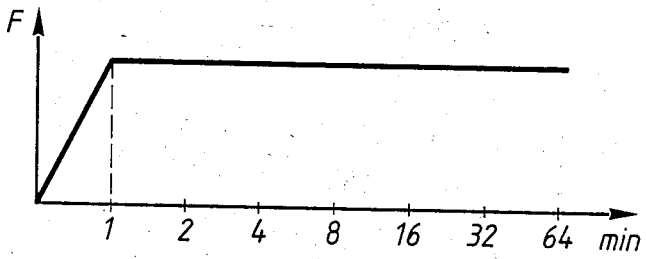
FIG. 3 is a graph showing the filling rate curves.
Figure 4:
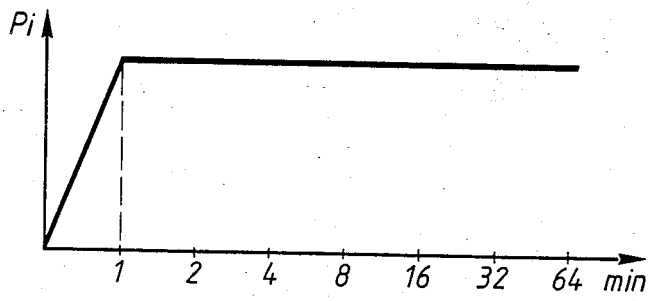
FIG. 4 is a graph showing the pinch limit rate.

Assuming that the steel supply F is at a temperature of 1500° C. and that the tundish has been preheated to or close to 1000° C. but the inductor unpowered, FIG. 2 illustrates by its solid line curve 8 the steel temperature drop that can be expected during the filling of the tundish, the rate of filling is shown by the curve of FIG. 3 during which the pinch limit curve of FIG. 4 increases until the steel in the tundish 1 is at its operating level or full.

As shown by the broken thin line 9 in FIG. 2 it is desirable that there be no temperature drop at all. With the present invention it is possible to obtain the moderate temperature drop indicated by the broken heavy line 10 in FIG. 2.

Figure 5:
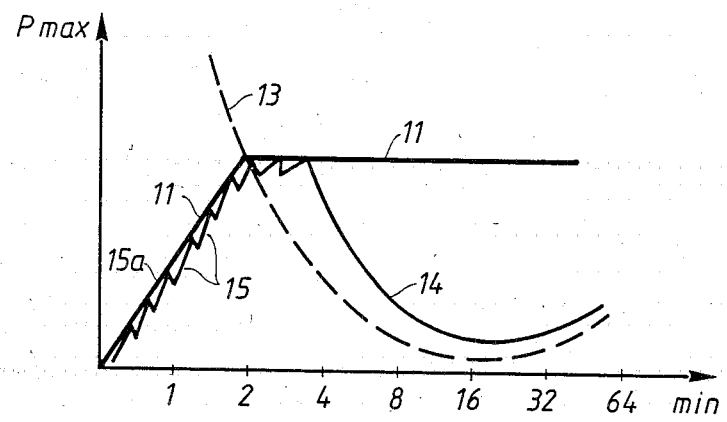
FIG. 5 shows the inductor power feed curve of the invention and its relation to the pinch limit curve.

The present invention is graphically shown by FIG. 5 where the inductor power rise ramp 15 closely follows the pinch limit curve 11 which climbs during almost a two minute filling time period until leveling off because the tundish has filled. As soon as the steel being cast in the empty or substantially empty tundish reaches a level above the inductor channel openings the thyristor converter 4A is operated so as to power the inductor coil 4 with rapidly increasing power so that the pinch limit is rapidly reached as indicated at 15A in FIG. 5. At this point of incipient pinching the power is momentarily rapidly reduced as indicated.

As the steel level increasingly rises so the steel static pressure further increases, the power supply to the coil 4 is again increased rapidly so as to again cause incipient pinching in the inductor channel 7 and just before pinching occurs the power is then again rapidly momentarily reduced.

As shown by FIG. 5 these steps are continued sequentially without interruptions until the pinch limit plateau is safely reached because the tundish is at its full operating level, providing the maximum static pressure, and permitting maximum powering of the inductor coil 4. FIG. 5 shows the overall possible power climb or ramp 15 of the uninterrupted sequential steps of rapidly increasing the inductor power to the pinching limit or point of incipient pinching, then immediately rapidly dropping the power only to again cause the power to climb rapidly until again reaching the pinch limit. The curve 11 of course shows the pinch limit climb with the increasing hydrostatic pressure of the filling steel. Curve 13 shows the power requirement and the feed in power used is shown by curve 14 in FIG. 5. The power drops may range from 5 to 10% of the power applied for the increases of current.

There are various ways of detecting when pinching occurs in the channel of any channel-type inductor and one is to measure the inductor power supply current, because at that time the current suddenly reduces. It is for this reason that the current power indicator is shown in FIG. 1. Preferably the system is computerized so as to automatically control the AC power source such as the convertor 4A, so as to provide the described sequence of steps.

The temperature curve 10 shown in FIG. 2 can closely approximate the ideal curve 9 without pinching occurring. As shown at 12 in FIG. 2 there is a tendency for the temperature of the steel to drop as the continuous casting operation nears completion but this can be rapidly lifted by the use of the inductor.

Although this invention is particularly useful in conjunction with the continuous casting of steel, its principles are applicable whenever a tundish is to be filled with molten metal when the tundish is provided with a channel-type inductor.

What is claimed is:

1. A method for continuously pouring molten metal in an initially substantially unfilled tundish having a channel-type inductor having a channel opening into the bottom portion of the tundish, comprising starting the pouring and while continuously pouring the sequential steps of applying power to the inductor when its channel is first covered by the pouring metal to form a metal level and the static pressure of the metal is low and while increasing the power rapidly so as to cause incipient pinching in the channel and then momentarily rapidly reducing the power so as to prevent pinching; as the metal level further increases so that the metal's static pressure further increases, again increasing the power rapidly so as to again cause incipient pinching in the channel and then again momentarily rapidly reducing the power so as to prevent pinching; and continuing the sequential steps until the tundish is filled.

2. The method of claim 1 in which each of the sequential steps immediately follows a preceding one of the sequential steps so as to provide a substantially continuously increasing power supply to the inductor.

* * * * *